US007055626B2

(12) United States Patent
Wells et al.

(10) Patent No.: US 7,055,626 B2
(45) Date of Patent: Jun. 6, 2006

(54) CORE BIT HAVING FEATURES FOR CONTROLLING FLOW SPLIT

(75) Inventors: Michael R. Wells, Lakewood, CO (US); Luc Van Puymbroeck, Kingwood, TX (US); Holger Stibbe, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 379 days.

(21) Appl. No.: 10/099,873

(22) Filed: Mar. 15, 2002

(65) Prior Publication Data

US 2003/0173116 A1 Sep. 18, 2003

(51) Int. Cl.
*E21B 49/02* (2006.01)
*E21B 10/02* (2006.01)
*E21B 10/61* (2006.01)

(52) U.S. Cl. ..... 175/58; 175/393; 175/404

(58) Field of Classification Search ..... 175/57, 175/58, 239, 244–255, 393, 403, 404
See application file for complete search history.

(56) References Cited

U.S. PATENT DOCUMENTS 2,046,798 A * 7/1936 Thrift ..... 175/46
2,064,255 A * 12/1936 Garfield ..... 175/257
2,113,968 A * 4/1938 Thrift ..... 175/67
2,147,896 A * 2/1939 Harrington ..... 175/58
2,769,615 A * 11/1956 Burgess ..... 175/246
3,308,896 A 3/1967 Henderson
3,621,924 A * 11/1971 Lebourg ..... 175/58
4,002,213 A * 1/1977 Sweeney ..... 175/58
4,598,777 A * 7/1986 Park et al. ..... 175/58
4,606,416 A * 8/1986 Knighton et al. ..... 175/58
4,607,710 A * 8/1986 Radford ..... 175/249
4,735,269 A * 4/1988 Park et al. ..... 175/46
4,787,465 A * 11/1988 Dickinson et al. ..... 175/67

(Continued)

FOREIGN PATENT DOCUMENTS

DE 3918132 A1 * 12/1989

(Continued)

OTHER PUBLICATIONS

Clydesdale, G.M., et al., "Low Invasion Corehead Reduces Mud Invasion While Improving Performances," J. Energy Resources Tech., vol. 116, pp. 258-267 (Dec. 1994).

(Continued)

*Primary Examiner*—Jennifer H. Gay
(74) *Attorney, Agent, or Firm*—TraskBritt

(57) ABSTRACT

A core bit for cutting core samples in subterranean formations. The core bit has interior geometric features configured to control the quantity of drilling fluid, or flow split, flowing into a narrow annulus defined by an inside diameter of the core bit and an outside diameter of a core shoe. Reducing the flow split minimizes fluid invasion of a core being cut; thus, the core bit provides increased core quality and recoverability. The core bit is also adaptable for use with conventional core barrel assemblies and conventional coring techniques.

16 Claims, 8 Drawing Sheets

U.S. PATENT DOCUMENTS

| | | | | |
|---|---|---|---|---|
| 4,930,587 | A * | 6/1990 | Young et al. | 175/251 |
| 4,981,183 | A | 1/1991 | Tibbitts | |
| 5,460,230 | A | 10/1995 | Dekoster | |
| 5,568,838 | A | 10/1996 | Struthers et al. | |
| 5,669,459 | A | 9/1997 | Larsen et al. | |
| 5,862,871 | A * | 1/1999 | Curlett | 175/340 |
| 6,164,389 | A * | 12/2000 | Fanuel et al. | 175/20 |
| 6,341,656 | B1 * | 1/2002 | Fanuel et al. | 175/244 |
| 6,390,211 | B1 * | 5/2002 | Tibbitts | 175/340 |
| 6,394,196 | B1 * | 5/2002 | Fanuel et al. | 175/245 |

FOREIGN PATENT DOCUMENTS

| | | | |
|---|---|---|---|
| EP | 0 356 657 | B1 | 3/1994 |
| GB | 2 318 372 | A | 4/1998 |
| WO | WO 9428281 | A1 * | 12/1994 |

OTHER PUBLICATIONS

Search Report dated May 1, 2003.
Belgian Search Report, dated Feb. 14, 2005.

* cited by examiner

CORE BIT HAVING FEATURES FOR CONTROLLING FLOW SPLIT

BACKGROUND OF THE INVENTION

1. Field of the Invention

The present invention relates generally to apparatus and methods for taking core samples of subterranean formations. More specifically, the present invention relates to a core bit having features to control flow of drilling fluid into a narrow annulus between the core bit inside diameter and the outside diameter of an associated core shoe of a coring apparatus for reduction in drilling fluid contact with, and potential invasion and contamination of, a core being cut.

2. State of the Art

Formation coring is a well-known process in the oil and gas industry. In conventional coring operations, a core barrel assembly is used to cut a cylindrical core from the subterranean formation and to transport the core to the surface for analysis. Analysis of the core can reveal invaluable data concerning subsurface geological formations—including parameters such as permeability, porosity, and fluid saturation—that are useful in the exploration for petroleum, gas, and minerals. Such data may also be useful for construction site evaluation and in quarrying operations.

A conventional core barrel assembly typically includes an outer barrel having, at one end, a core bit adapted to cut the cylindrical core and to receive the core in a central opening, or throat. The opposing end of the outer barrel is attached to the end of a drill string, which conventionally comprises a plurality of tubular sections that extends to the surface. Located within, and releasably attached to, the outer barrel is an inner barrel assembly having an inner tube configured for retaining the core. The inner barrel assembly further includes a core shoe disposed at one end of the inner tube adjacent the throat of the core bit. The core shoe is configured to receive the core as it enters the throat and to guide the core into the inner tube. Both the inner tube and core shoe are suspended within the outer barrel and rotate freely with respect to the core bit and outer barrel. Thus, as the core is cut—by application of weight to the core bit through the outer barrel and drill string in conjunction with rotation of these components—the core will traverse the throat of the core bit to eventually reach the rotationally stationary core shoe, which accepts the core and guides it into the inner tube assembly where the core is retained until transported to the surface for examination.

Conventional core bits are generally comprised of a bit body having a face surface on one end. The opposing end of the core bit is configured, as by threads, for connection to the outer barrel. Located at the center of the face surface is the throat, which extends into a hollow cylindrical cavity formed in the bit body. The face surface includes a plurality of cutters arranged in a selected pattern. The pattern of cutters includes at least one outside gage cutter disposed near the periphery of the face surface that determines the diameter of the bore hole drilled in the formation. The pattern of cutters also includes at least one inside gage cutter disposed near the throat that determines the outside diameter of the core being cut.

During coring operations, a drilling fluid is usually circulated through the core barrel assembly to lubricate and cool the plurality of cutters disposed on the face surface of the core bit and to remove formation cuttings from the bit face surface to be transported upwardly to the surface through the annulus defined between the drill string and the wall of the bore hole. A typical drilling fluid, or drilling mud, may be a hydrocarbon or water base in which fine-grained mineral matter is suspended. The core bit includes one or more ports or nozzles positioned to deliver drilling fluid to the face surface. Generally, a port includes a port outlet at the face surface in fluid communication with a bore. The bore extends through the bit body and terminates at a port inlet. Each port inlet is in fluid communication with an upper annular region formed between the bit body and the inner tube and core shoe. Drilling fluid received from the drill string under pressure is circulated in the upper annular region, which enables the port inlet of each port to draw drilling fluid from the upper annular region. Drilling fluid then flows through each bore and discharges at its associated port outlet to lubricate and cool the plurality of cutters on the face surface and to remove formation cuttings as noted above.

In conventional core barrel assemblies, a narrow annulus exists in the region bounded by the inside diameter of the bit body and the outside diameter of the core shoe. The narrow annulus is essentially an extension of the upper annular region and, accordingly, the narrow annulus is in fluid communication with the upper annular region. Thus, in addition to flowing into the port inlets, the pressurized drilling fluid circulating in the upper annular region also flows into the narrow annulus between the bit body and core shoe. The drilling fluid bypassing the port inlets and continuing into the narrow annulus is commonly referred to as the "flow split." The narrow annulus terminates at the entrance to the core shoe and any drilling fluid flowing within its boundaries is exhausted proximate the throat of the core bit. As a result, drilling fluid flowing from the narrow annulus, or flow split, will contact the exterior surface of the core being cut as the core traverses the throat and enters the core shoe.

A high flow split can create significant problems during coring operations, especially when coring in relatively soft to medium hard formations, or in unconsolidated formations. Drilling fluids discharged near the core as it traverses the throat and enters the core shoe can invade and contaminate the core itself. For soft or unconsolidated formations, these drilling fluids invading the core may wash away, or otherwise severely disturb, the material of the core. The core may be so badly damaged by the drilling fluid invasion that standard tests for permeability, porosity, and other characteristics produce unreliable results, or cannot be performed at all. Fluid invasion of unconsolidated or fragmented cores is a matter of great concern in the petroleum industry as many hydrocarbon-producing formations, such as sand and limestone, are of the unconsolidated type. For harder formations, drilling fluid coming into contact with the core may still penetrate the core, contaminating the core and making it difficult to obtain reliable test data. Thus, limiting fluid invasion of the core can greatly improve core quality and recoverability while yielding a more reliable characterization of the drilled formation.

Apparatus and coring methods for reducing fluid invasion of the core have been proposed. U.S. Pat. No. 4,981,183 to Tibbitts and U.S. Pat. No. 5,568,838 to Struthers et al. each disclose a flow restriction in the narrow annulus between the bit body inside diameter and the core shoe outside diameter. The flow restriction is comprised of a bearing surface on the core shoe in sliding contact with a mating shelf on the core bit. A substantial fluid seal is essentially formed in the contact region between the bearing surface and the shelf. However, maintenance of a reliable fluid seal during a coring operation requires continuous contact, or at least close proximity, between the bearing surface and the shelf as the bearing surface rotates relative to the shelf.

U.S. Pat. No. 5,460,230 to Dekoster also discloses the introduction of a flow restriction into the narrow annulus between the bit body inside diameter and the core shoe outside diameter. The fluid restriction is comprised of an annular lip formed at the end of the core shoe and a corresponding annular slot on the inside diameter of the core bit body. The substantially mating relationship between the annular lip and annular slot forms a 180 degree bend in the flow path of the narrow annulus. The dimensions of the annular lip and annular slot can be selected such that flow resistance is optimized and, accordingly, flow split is minimized. However, in addition to requiring the formation of an annular lip on the core shoe, the bit body and core shoe must be manufactured to precise tolerances in order to maintain the desired flow restriction while simultaneously minimizing interference contact between the core shoe and bit body as they rotate relative to one another during coring.

In addition to the flow restriction in the narrow annulus, the Dekoster patent discloses modifications to the ports extending through the bit body. Each port includes a deflected outlet nozzle and a bore inclined away from the cut core. The deflected outlet nozzle and inclined bore direct drilling fluid away from the core as the drilling fluid exits the port outlet on the face surface of the bit. To further encourage flow of drilling fluid away from the core, a fluid stream detachment effect is created by locating each port outlet on a lateral surface between two successive blades. The blades, which have cutters disposed thereon, are raised relative to the lateral surfaces and port outlets. The fluid stream detachment facilitates the flow of drilling fluid away from the core as the drilling fluid exhausts through the deflected outlet nozzles. Such modifications to the bore and port outlet of each port, however, do not affect flow split through the narrow annulus.

Therefore, a need exists in the art of formation coring for apparatus and methods of reducing the flow of drilling fluids in the narrow annulus between the bit body inside diameter and the core shoe outside diameter, or flow split. Minimization of flow split will reduce fluid invasion of the core. Conventional core bits have a highly robust design and construction as the mechanical and chemical environments in which the core bit must operate can be severe. Thus, any core bit having features for reducing flow split must be reliable and easily maintained while, at the same time, not compromising the ruggedness of the core bit during coring operations.

BRIEF SUMMARY OF THE INVENTION

The present invention comprises a core bit of a configuration offering reduced flow split, reduced drilling fluid invasion of a core and, thus, improved core quality and recoverability, in comparison to conventional core bits. The core bit according to the present invention may be used with conventional core barrel assemblies and, further, is adaptable to conventional coring methods. The novel features of the improved core bit of the invention do not compromise the ruggedness of the core bit; therefore, the core bit of the present invention can withstand the severe mechanical and chemical environments encountered during coring operations.

In one embodiment of the present invention, decreased flow split is achieved by increasing the cross-sectional area of the ports that is open to receive flow from the upper annular region. Increased cross-sectional area to receive flow may be achieved by imparting a suitable shape to the port inlets. A generally conical shape at the port inlet has experimentally been shown to be adequate for this purpose. In another embodiment, decreased flow split is achieved by relaxing the angle of approach at the port inlets. Relaxing the angle of approach at the port inlets orients the port inlets more nearly parallel to the flow path extending down from the upper annular region and provides a smooth low angle flow transition into the port inlets. Experimentally, it has been shown that relaxing the angle of approach from a conventional angle of 45 degrees to an angle of about 30 degrees is suitable for this purpose.

In yet another embodiment of the core bit according to the present invention, the volume of an annular reservoir to feed the ports is increased. The annular reservoir, which receives drilling fluid from the upper annular region, also feeds the narrow annulus. An annular reservoir with greater volume provides additional time for flow entering the annular reservoir to reorganize and distribute throughout the entire volume of the annular reservoir, thereby allowing drilling fluid to flow circumferentially around the annular reservoir and feed into the port inlets, rather than flowing axially through the annular reservoir past the port inlets and into the narrow annulus therebelow. It has been shown experimentally that up to about a 70 percent increase in the volume of the annular reservoir is adequate for this purpose.

In still another embodiment of the present invention, reduced flow split is accomplished by introducing surface or topographic features into the flow path boundary, or boundary profile, of the narrow annulus to increase resistance to fluid flow in the narrow annulus. Experimentally, it has been shown that squared edges, rectangular reliefs, triangular reliefs, or circular reliefs disposed on the boundary profile of the narrow annulus are suitable for this purpose.

BRIEF DESCRIPTION OF THE SEVERAL VIEWS OF THE DRAWINGS

While the specification concludes with claims particularly pointing out and distinctly claiming that which is regarded as the present invention, the features and advantages of this invention can be more readily ascertained from the following detailed description of the invention when read in conjunction with the accompanying drawings, in which:

DETAILED DESCRIPTION OF THE PREFERRED EMBODIMENTS

FIGS. 1 through 11 make reference to many identical elements, and these identical elements retain the same numerical designation in all figures.

Figure 1:
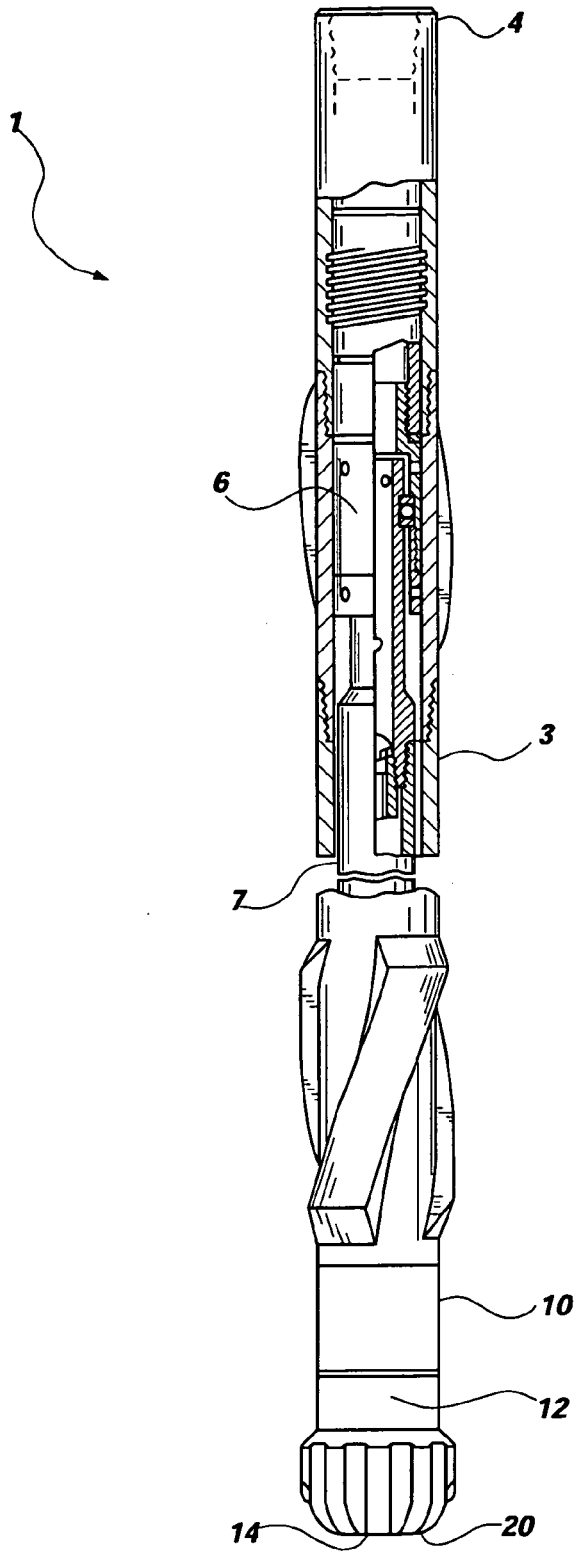
Fig. 1 (PRIOR ART)
FIG. 1 is a side, partial elevation of a conventional core barrel assembly for cutting a core sample from a subterranean formation.

Shown in FIG. 1 is an exemplary embodiment of a conventional core barrel assembly 1. The conventional core barrel assembly 1 includes an outer barrel 3 having a core bit 10 disposed at one end thereof. The opposing end 4 of the outer barrel 3 is configured for attachment to a drill string (not shown). The conventional core bit 10 includes a bit body 12 having a face surface 20. Disposed on the face surface 20 is a central opening, or throat 14, that extends into the bit body 12 and is adapted to receive a core (not shown) being cut.

Removably disposed inside the outer barrel 3 is an inner barrel assembly 6. The inner barrel assembly 6 includes an inner tube 7 adapted to receive and retain a core for subsequent transportation to the surface. The inner barrel assembly 6 further includes a core shoe (not shown in FIG. 1) disposed adjacent the throat 14 for receiving the core and guiding the core into the inner tube 7. A conventional core barrel assembly may have many other features not shown or described with reference to FIG. 1, which have been omitted for clarity and ease of understanding. However, it is to be understood that a conventional core barrel assembly may include many features in addition to those shown in the exemplary core barrel assembly 1 depicted in FIG. 1.

Figure 2:
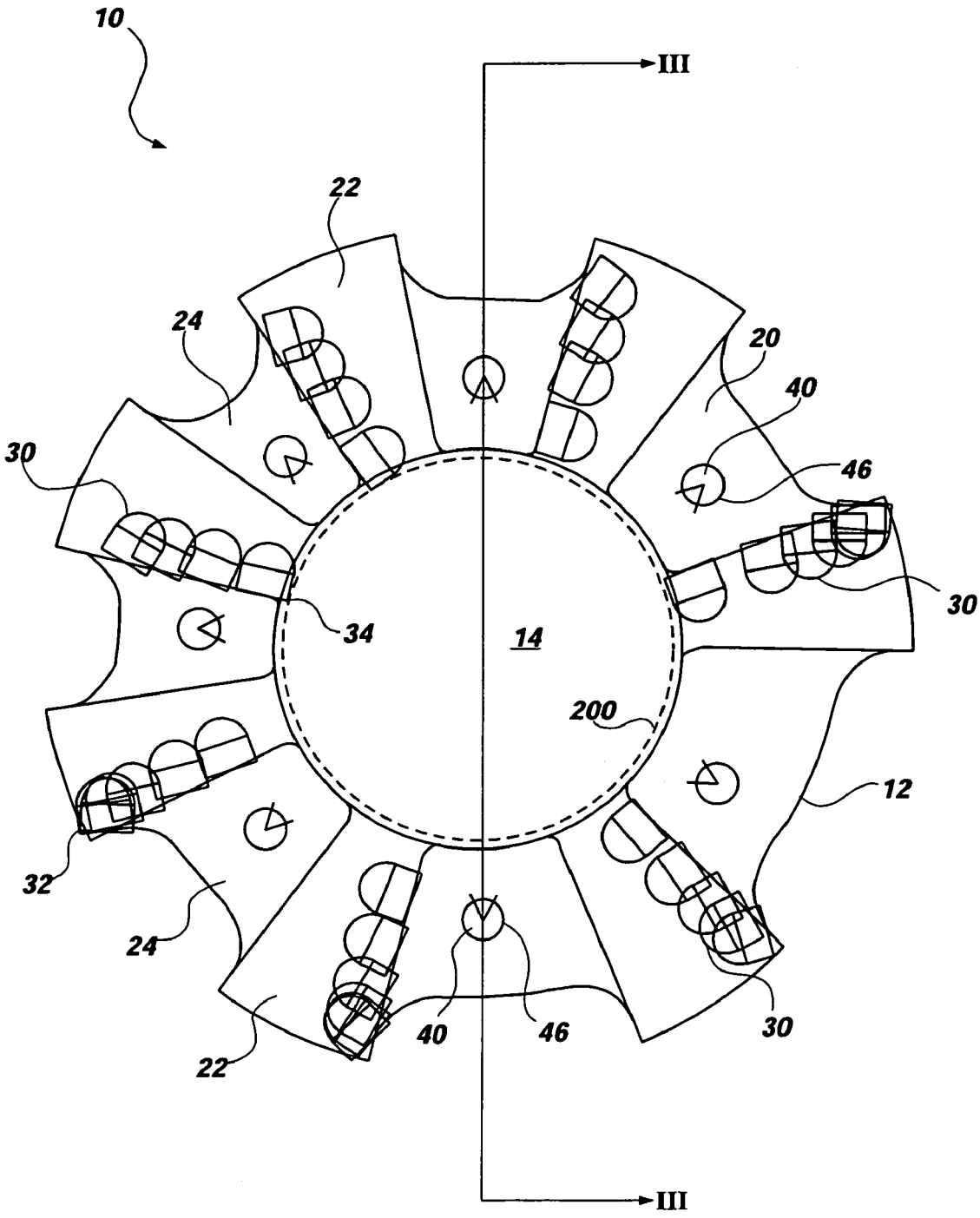
Fig. 2 (PRIOR ART)
FIG. 2 is a bottom, face view of an exemplary core bit.
Figure 3:
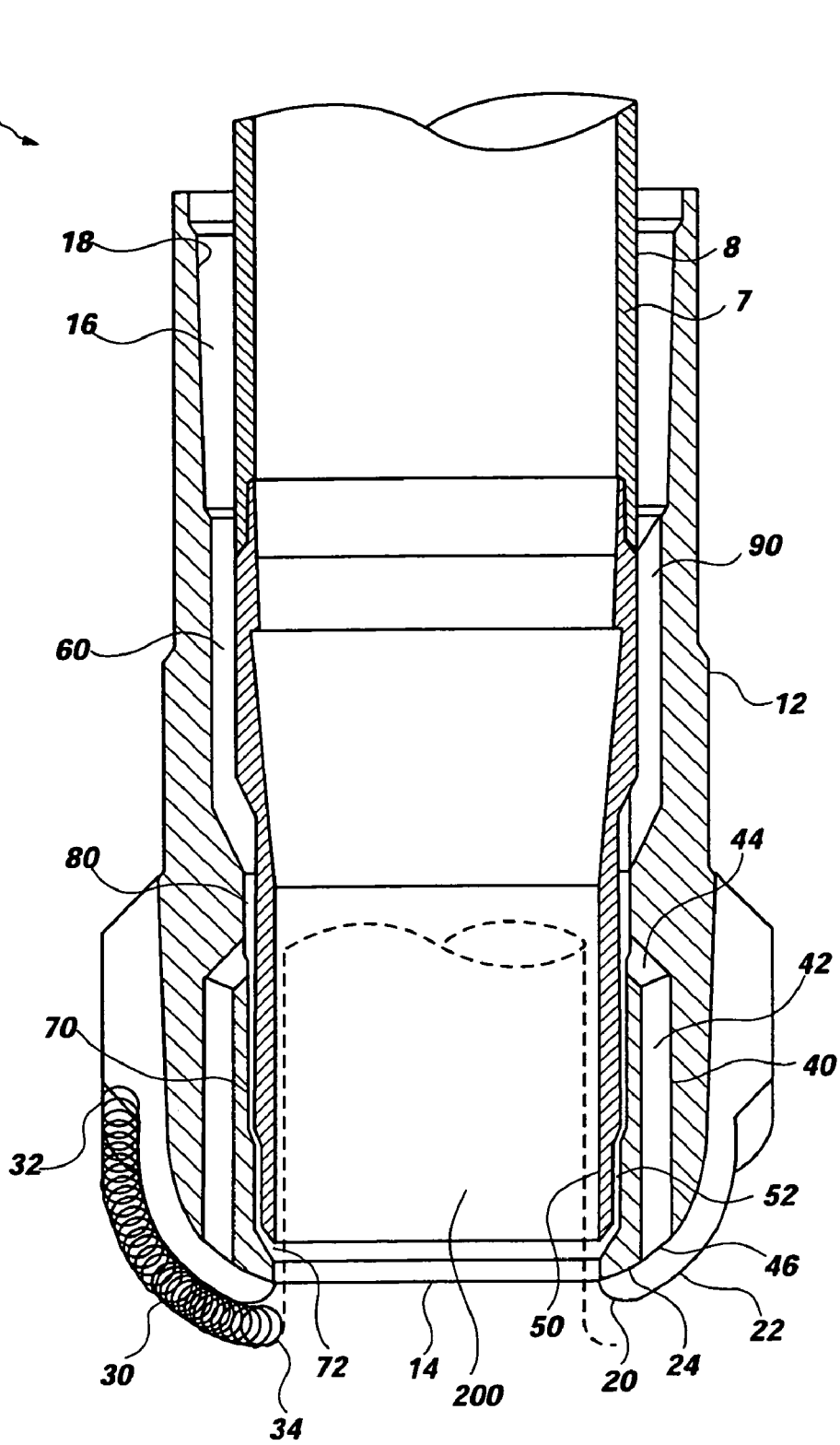
Fig. 3 (PRIOR ART)
FIG. 3 is a cross-sectional view of the exemplary core bit of conventional interior configuration and associated core shoe and inner tube taken along line III—III of FIG. 2.

FIGS. 2 and 3 show a core bit 10 as depicted in FIG. 1. FIG. 2 shows a bottom view of the core bit 10, while FIG. 3 shows a cross-sectional view of the core bit 10 as taken along line III—III of FIG. 2.

As can be seen in FIG. 2, the throat 14 opens into the bit body 12 at the face surface 20. Disposed on the face surface 20 is a plurality of blades 22. Attached to the blades 22 is a plurality of cutters 30 arranged in a selected pattern. The pattern of cutters 30—shown rotationally superimposed one upon another along the bit profile in FIG. 3—includes at least one outside gage cutter 32 that determines the diameter of the bore hole cut in the formation. The pattern of cutters 30 also includes at least one inside gage cutter 34 that determines the diameter of the core 200 (shown by dashed line) being cut and entering the throat 14.

Formed on the face surface 20 between successive blades 22 are radially extending fluid courses 24, the face surface of which may be depressed relative to the blades 22. The bit body 12 further includes one or more ports 40, each port 40 having a port outlet 46 disposed on one of the radially extending fluid courses 24 (see FIG. 2). Drilling fluid for lubricating the cutters 30 during a coring operation is delivered to the face surface 20 via the port outlet 46 of each port 40. Each port 40 further includes a bore 42 extending from the port outlet 46 through the bit body 12 and terminating at a port inlet 44 (see FIG. 3).

The bit body 12 has an inner, substantially cylindrical cavity 16 extending longitudinally therethrough and bounded by an inside diameter 18. The throat 14 opens into the inner substantially cylindrical cavity 16. Extending into the inner substantially cylindrical cavity 16 of the bit body 12 is the inner tube 7. Disposed at the lower end of the inner tube 7 adjacent the throat 14 is a core shoe 50. The inner tube 7 and core shoe 50 are suspended so as to be able to freely rotate with respect to the core bit 10 and outer barrel 3. The core shoe 50 is configured and located to receive the core 200 as the core 200 traverses the throat 14 and to guide the core 200 into the inner tube 7. The core 200 is then retained in the inner tube 7 until the core 200 is transported to the surface for analysis.

An upper annular region 60 is defined by the volume bounded between the inside diameter 18 of the bit body 12 and the outside diameters 8, 52 of the inner tube 7 and core shoe 50, respectively. The bit body 12 may include one or more axially and radially extending ribs 90 disposed about the circumference of the inside diameter 18 of the bit body 12. During a coring operation, drilling fluid is circulated under pressure within the upper annular region 60 such that drilling fluid can flow into the port inlet 44 of each port 40. The drilling fluid then flows through the bore 42 and is discharged at the port outlet 46 on the face surface 20. As best seen in the enlarged cross-sectional view of FIG. 5, the port inlet 44 has a shape 47 that is generally cylindrical and of a constant diameter. The port inlet 44 further has an angle of approach 48 relative to the flow path extending down from the upper annular region 60. A typical angle of approach 48 for a conventional drill bit is approximately 45 degrees.

A narrow annulus 70 is defined by the volume bounded between the inside diameter 18 of the bit body 12 proximate its lower end and the outside diameter 52 of the core shoe 50. The narrow annulus 70 is essentially an extension of, and in fluid communication with, the upper annular region 60. The narrow annulus 70, which may best be seen in the enlarged cross-sectional view shown in FIG. 7, includes a boundary profile 74 that defines the shape of the flow path in the narrow annulus 70. Disposed proximate the port inlets 44 is an annular reservoir 80 defined by a region bounded between the adjacent inside diameter 18 of the bit body 12 and the outside diameter 52 of the core shoe 50. The annular reservoir 80 has a radial width 82 (see FIGS. 5 and 7). Drilling fluid circulating in the upper annular region 60 collects in the annular reservoir 80, where the drilling fluid can feed into the port inlets 44 for delivery to the face surface 20.

Drilling fluid circulating in the upper annular region 60 and collecting in the annular reservoir 80 will also flow into the narrow annulus 70. Drilling fluid entering the narrow annulus 70—the flow split—will flow therethrough and exit the narrow annulus 70 through an annular gap 72 proximate the throat 14. The flow split can contact, and thereby invade and contaminate, the core 200 as the core 200 traverses the throat 14 and enters the core shoe 50.

A conventional core bit may have many other features not shown or described in FIGS. 2, 3, 5, and 7, as some aspects of conventional core bits have been omitted from the text and figures for clarity and ease of understanding. However, it is to be understood that a conventional core bit may include many features in addition to those shown in the exemplary core bit 10 depicted in FIGS. 2, 3, 5, and 7. It is to be further understood that a conventional core bit may not contain all of the features herein described.

Figure 4:
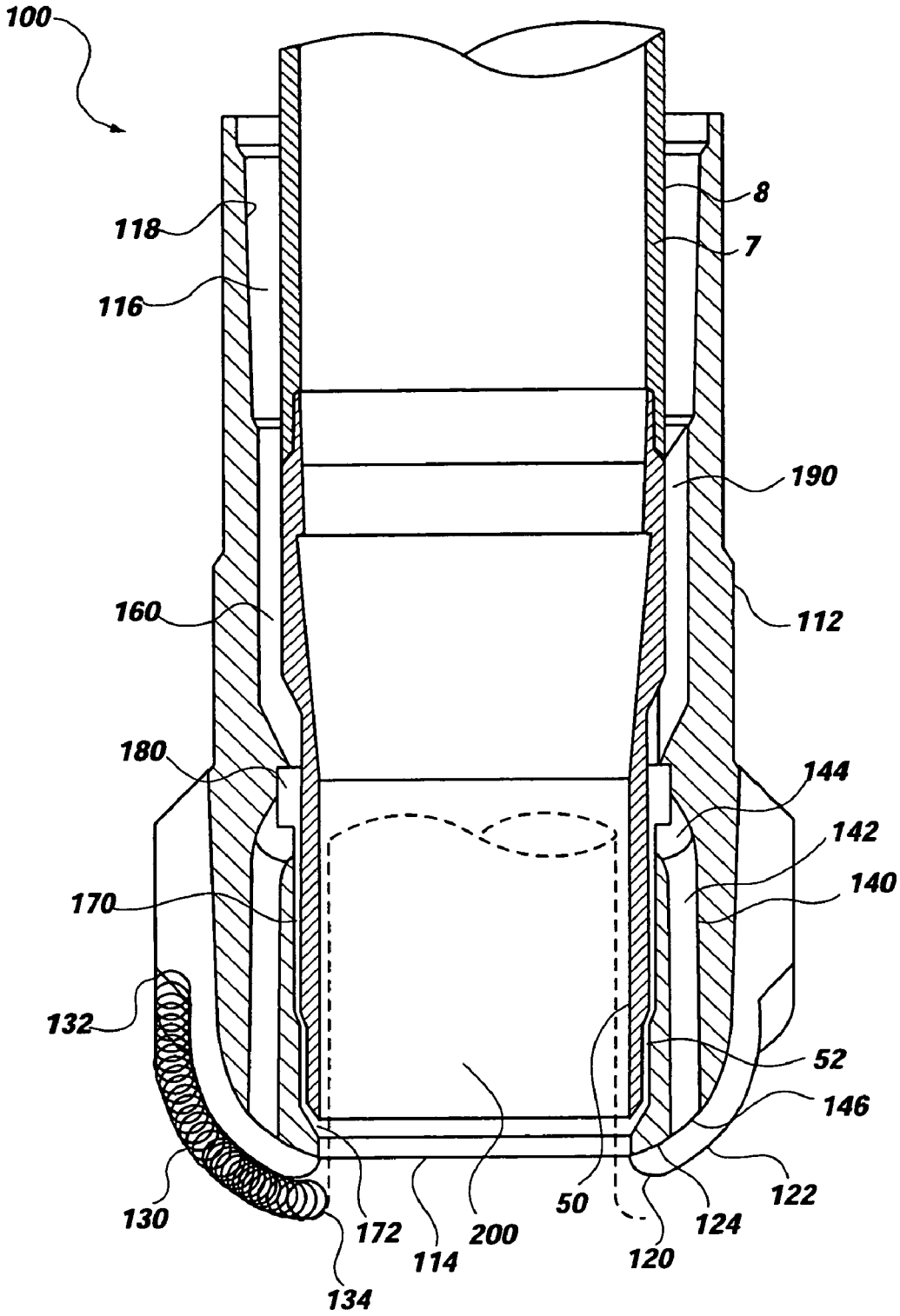
FIG. 4 is a cross-sectional view of a core bit of an interior configuration according to the present invention and associated core shoe and inner tube as taken along line III—III of FIG. 2.
Figure 5:
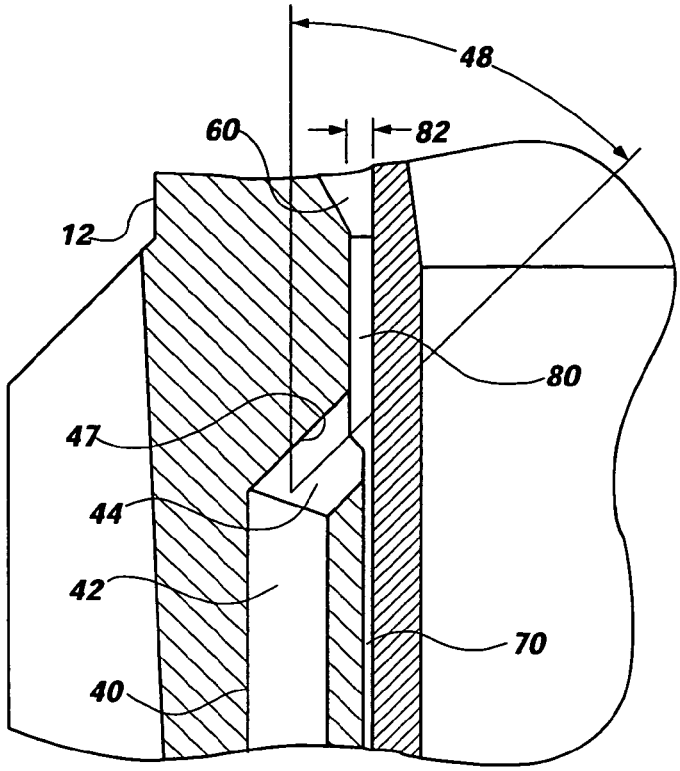
Fig. 5 (PRIOR ART)
FIG. 5 is an enlarged partial view of the exemplary core bit shown in cross-section in FIG. 3.

Shown in FIG. 4 is a core bit 100 having features for controlling flow split according to the present invention. The core bit 100 is disposed at the end of an outer barrel (not shown in FIG. 4) of a conventional core barrel assembly. The core bit 100 includes a bit body 112 having a face surface 120. A throat 114 configured to receive a core 200 (shown by dashed line) being cut opens at the face surface 120 and extends into the bit body 112.

A plurality of blades 122 is disposed on the face surface 120 and a plurality of cutters 130 is attached to the blades 122. The plurality of cutters 130 is arranged on the face surface 120 in a selected pattern having at least one outside gage cutter 132, which determines the diameter of the bore hole cut in the formation, and at least one inside gage cutter 134, which determines the diameter of the core 200 being cut. Formed on the face surface 120 between successive blades 122 are radially extending fluid courses 124. The radially extending fluid courses 124 may be depressed relative to the blades 122.

The bit body 112 further includes an inner, substantially cylindrical cavity 116 longitudinally extending therethrough and bounded by an inside diameter 118. The throat 114 opens into the inner, substantially cylindrical cavity 116. Extending into the inner, substantially cylindrical cavity 116 is an inner tube 7. Disposed at the lower end of the inner tube 7 adjacent the throat 114 is a core shoe 50. The inner tube 7 and core shoe 50 are suspended within the outer barrel and freely rotate relative to the core bit 100 and the outer barrel. The core shoe 50 is configured and located to receive the core 200 as the core 200 traverses the throat 114 and to guide the core 200 into the inner tube 7, where the core 200 is retained until being transported to the surface. The bit body 112 may also include one or more axially and radially extending ribs 190 disposed about the circumference of the inside diameter 118.

The bit body 112 includes one or more ports 140, each port 140 having a port outlet 146 at a radially extending fluid course 124 and a bore 142 extending from the port outlet 146 through the bit body 112 and terminating at a port inlet 144. An upper annular region 160 is defined by the volume bounded between the inside diameter 118 of the bit body 112 and the outside diameters 8, 52 of the inner tube 7 and core shoe 50, respectively. During a coring operation, pressurized drilling fluid is circulated within the upper annular region 160. The drilling fluid circulating in the upper annular region 160 can flow into the port inlet 144 of each port 140, through the bore 142, and to the port outlet 146 on the face surface 120, where the drilling fluid is discharged.

A narrow annulus 170 is defined by the volume bounded between the inside diameter 118 proximate the lower end of the bit body 112 and the outside diameter 52 of the core shoe 50. The narrow annulus 170 is essentially an extension of the upper annular region 160 and is in fluid communication therewith. Disposed proximate the port inlets 144 is an annular reservoir 180. The annular reservoir 180 is defined by a region bounded between the inside diameter 118 of the bit body 112 adjacent the port inlets 144 and the outside diameter 52 of the core shoe 50.

Drilling fluid circulating in the upper annular region 160 collects in the annular reservoir 180, where the drilling fluid is distributed to the port inlets 144 for delivery to the face surface 120. Drilling fluid circulating in the upper annular region 160 and collecting in the annular reservoir 180 will also flow into the narrow annulus 170. Drilling fluid entering the narrow annulus 170, or flow split, will flow through the narrow annulus 170 and exit therefrom through an annular gap 172 proximate the throat 114. If unimpeded, the flow split exhausted from the narrow annulus 170 through the annular gap 172 can invade and contaminate the core 200.

As can be observed from the foregoing description of the core bit 100 according to the present invention, the core bit 100 has some features in common with the conventional core bit 10 shown in FIGS. 2, 3, 5, and 7. However, the core bit 100 of the present invention includes a number of novel features that individually, or in combination, may be employed to control the flow split in the narrow annulus 170, thereby preventing contamination of the core 200. These novel features are now described in detail.

Figure 6:
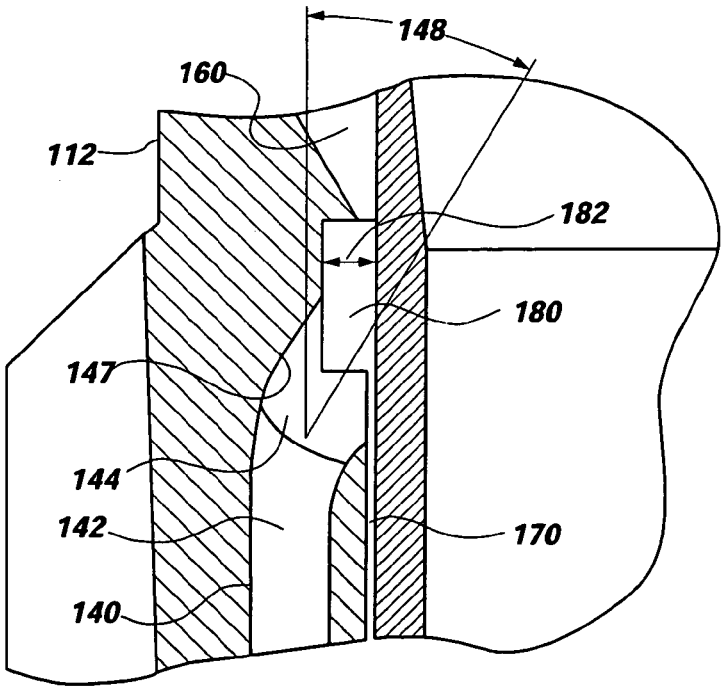
FIG. 6 is an enlarged partial view of the core bit according to the present invention shown in cross-section in FIG. 4.

Referring to FIG. 6, the port inlet 144 has a shape 147. As previously noted with respect to FIG. 5, the conventional core bit 10 has a port inlet 44 with a generally constant diameter, cylindrical shape 47. However, as shown in FIG. 6, the port inlets 144 of the core bit 100 have a shape 147 that is generally conical. The conical shape 147 has a minimum diameter, and hence minimum cross-sectional area, where a port inlet 144 joins with a bore 142. The diameter and cross-sectional area of the conical shape 147 gradually increases therefrom to a maximum diameter and cross-sectional area where each port inlet 144 opens into the annular reservoir 180 and narrow annulus 170. A conical shape 147 increases the cross-sectional area of the port inlets 144 open to receive fluid flow from the annular reservoir 180.

Figure 6A:
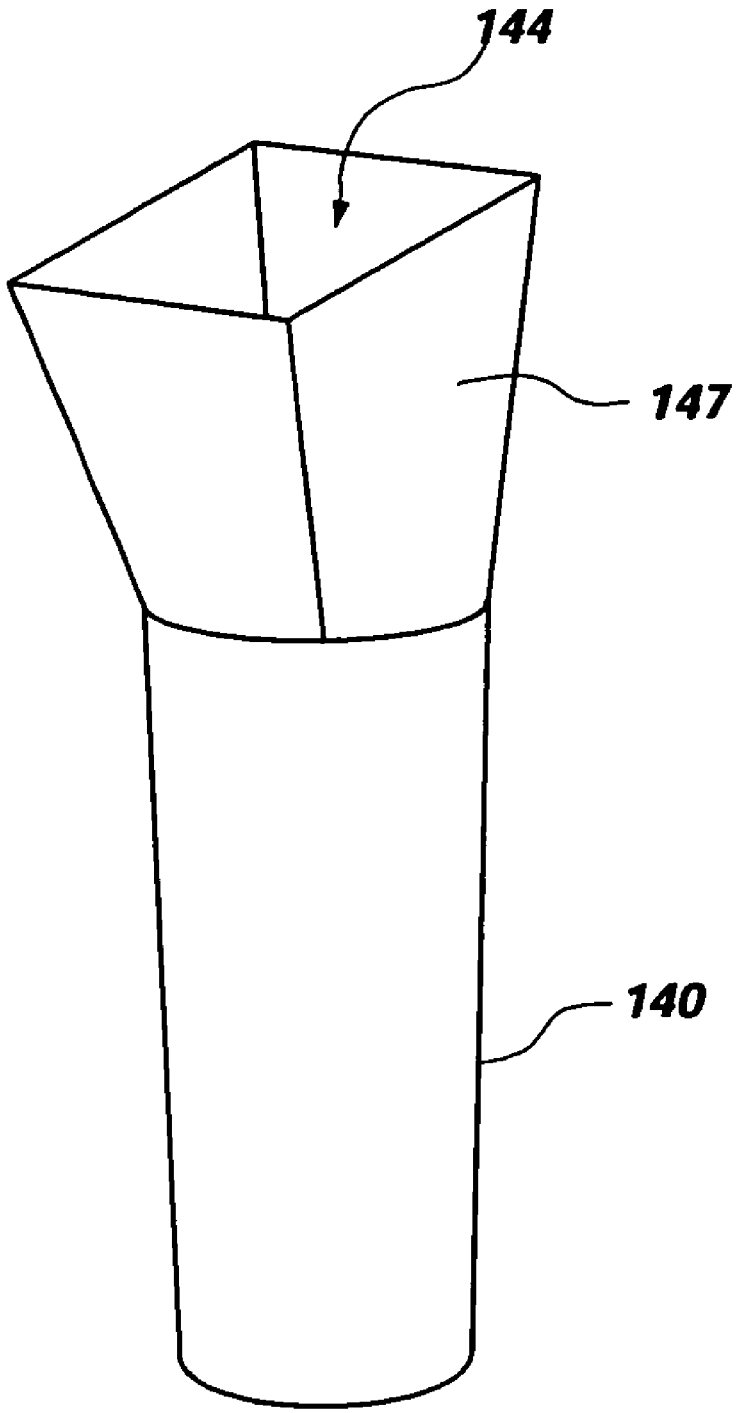
FIG. 6A is an enlarged partial view of a port of the present invention shown including a pyramidal port inlet.
Figure 7:
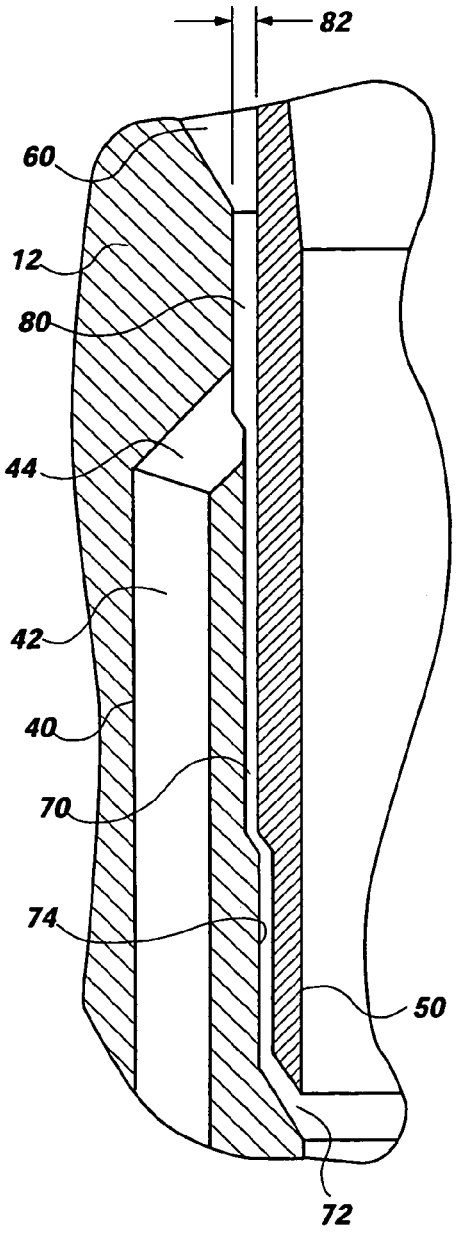
Fig. 7 (PRIOR ART)
FIG. 7 is an enlarged partial view of the exemplary core bit shown in cross-section in FIG. 3.

Those of ordinary skill in the art will understand that the narrow annulus 170 extends about the entire circumference of the bit body 112 and, therefore, has a large cross-sectional area open to receive fluid flow from the annular reservoir 180. In contrast, the port inlets 144 are singular, spaced entrances disposed about the circumference of the bit body 112. Thus, increasing the cross-sectional area of the port inlets 144 that can receive fluid flow from the annular reservoir 180 is of critical importance. Numerical studies performed with the aid of a computer indicate that a conical shape 147 at the port inlets 144 can decrease flow split by approximately 44 percent. It will be appreciated by those of ordinary skill in the art that the shape 147 at the port inlets 144 may be of any suitable configuration that increases the cross-sectional area open to receive fluid flow from the annular reservoir 180, such as, by way of example only, a pyramidal shape, as shown in FIG. 6A.

With reference again to FIG. 6, each port inlet 144 has an angle of approach 148 relative to the flow path extending down from the upper annular region 160 and the annular reservoir 180. As indicated with respect to FIG. 5, the port inlets 44 of the conventional core bit 10 have an angle of approach 48 of approximately 45 degrees. However, as can be seen in FIG. 6, the port inlets 144 of the core bit 100 have an angle of approach 148 that has been significantly relaxed as compared to the conventional 45 degree angle of approach. Relaxing the angle of approach 148, such that the port inlets 144 are more nearly parallel to the flow path extending down from the upper annular region 160 and the annular reservoir 180, provides a smooth low angle transition of flow into the port inlets 144. Numerical studies performed with the aid of a computer indicate that relaxing the angle of approach 148 to 30 degrees (as compared to the conventional 45 degree angle) reduces flow split by approximately 24 percent. Those of ordinary skill in the art will understand that the bit body 112 and associated ports 140 may be configured to provide an angle of approach 148 of approximately zero degrees, or any other suitable angle. An angle of approach in the range of from about 0 to 44 degrees is believed to be beneficial according to the invention.

Figure 8:
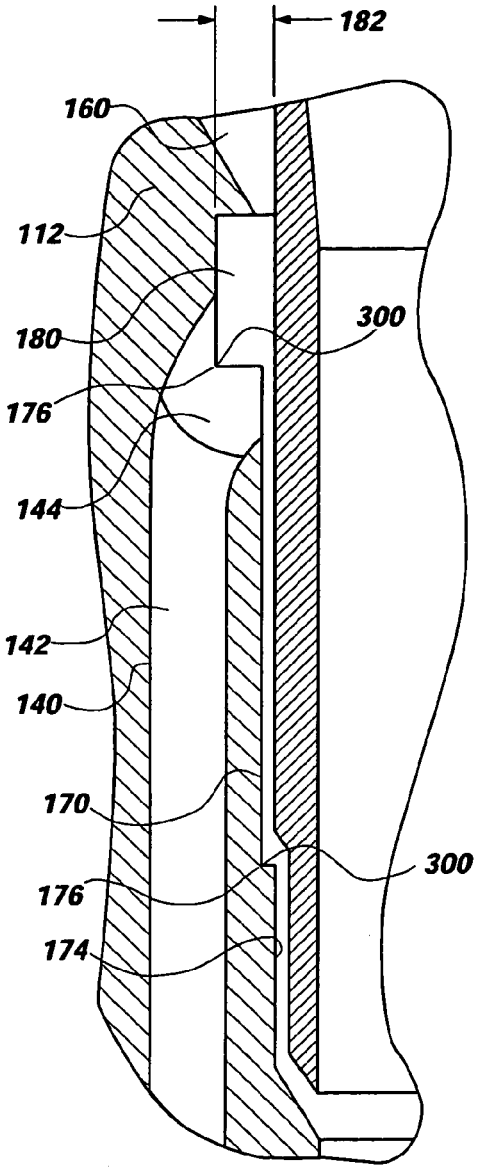
FIG. 8 is an enlarged partial view of the core bit according to the present invention shown in cross-section in FIG. 4.

Referring to FIGS. 6 and 8, the annular reservoir 180 has a radial width 182. The radial width 182, and hence the volume, of the annular reservoir 180 has been significantly increased as compared to the radial width 82 and volume of the annular reservoir 80 in the conventional core bit 10 (see FIGS. 5 and 7). Numerical studies performed with the aid of a computer indicate that increasing the volume of the annular reservoir 180 by up to approximately 70 percent (as compared to the volume of the annular reservoir 80 of the conventional core bit 10) will provide an approximate 19 percent reduction in flow split. Increases in the volume of the annular reservoir 180 beyond about 70 percent may be detrimental to the structural integrity of the core bit 100 as the corresponding increase in the radial width 182 may weaken the wall of the bit body 112. Those of ordinary skill in the art will understand that the upper limit on the increase in volume of the annular reservoir 180 and on the radial width 182 may vary depending on the design and geometry of the bit body 112 and on the material from which the bit body 112 is constructed.

The annular reservoir 180 is essentially a header volume feeding a plurality of ports. If the header volume is sufficiently large, all of the ports will generally receive approximately the same amount of fluid flow. However, if the header volume is too small, a few ports will receive preferential fluid flow relative to the other ports as flow into the header volume does not have sufficient time to reorganize and distribute itself throughout the extent of the header volume.

The example of a header volume feeding a plurality of ports can be extended and applied to the annular reservoir 180, which feeds the port inlets 144 and the narrow annulus 170. Again, it must be understood that the narrow annulus 170 extends about the entire circumference of the bit body 112, whereas the port inlets 144 are discrete openings disposed about the circumference of the bit body 112. By increasing the radial width 182, and therefore the volume, of the annular reservoir 180, the drilling fluid flowing into the annular reservoir 180 from the upper annular region 160 has additional time to reorganize and distribute throughout the entire volume of the annular reservoir 180. Providing a larger volume at the annular reservoir 180, and hence more time for flow reorganization, allows drilling fluid to flow circumferentially around the annular reservoir 180 where it can feed into the port inlets 144, as opposed to flowing axially through the annular reservoir 180 past the port inlets 144 and into the narrow annulus 170.

Referring to FIG. 8, the narrow annulus 170 has a boundary profile 174 on the lower interior of bit body 112 that defines the shape of the flow path through the narrow annulus 170. Flow split can be reduced by increasing the resistance to fluid flow in the narrow annulus 170. Resistance to fluid flow can be introduced into the narrow annulus 170 by altering the contour, or topography, of the flow path, or boundary profile 174. By way of example only, as shown in FIG. 8, one or more annular shelves having a squared edge 176 may be introduced into the boundary profile 174 (compare to the conventional smooth boundary profile 74 shown in FIG. 7). Numerical studies performed with the aid of a computer indicate that the formation of annularly extending squared edges 176 on the boundary profile 174 results in a 100 percent increase in pressure loss through the narrow annulus 170 as compared to a conventional configuration. The increased pressure loss in the narrow annulus 170 can be directly translated to a reduction in fluid flow through the narrow annulus 170 and, therefore, a reduction in flow split.

Figure 9:
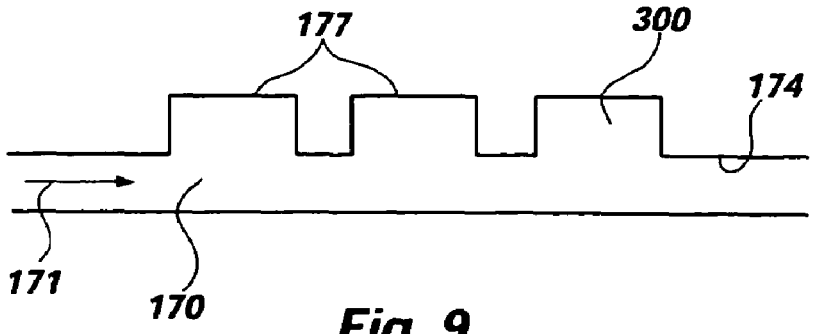
FIG. 9 is an enlarged cross-sectional view of a narrow annulus defined in part by a core bit exhibiting a first interior topography according to the invention.
Figure 10:
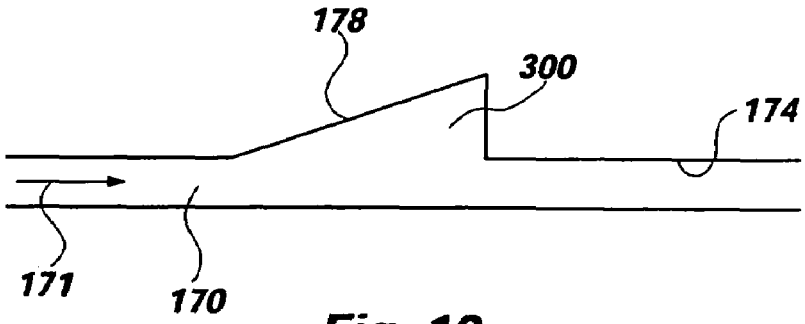
FIG. 10 is an enlarged cross-sectional view of a narrow annulus defined in part by a core bit exhibiting a second interior topography according to the invention.
Figure 11:
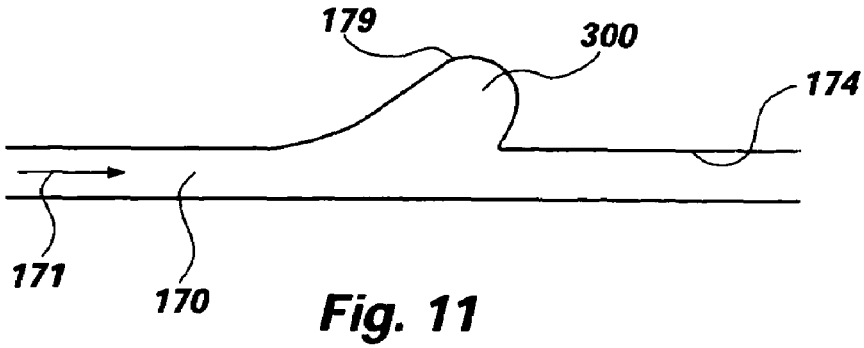
FIG. 11 is an enlarged cross-sectional view of a narrow annulus defined in part by a core bit exhibiting a third interior topography according to the invention.

Other surface features can be introduced into the boundary profile 174 to increase resistance to fluid flow through the narrow annulus 170. For example, one or more annular, rectangular cross-sectional reliefs 177 can be disposed along the boundary profile 174 as shown in FIG. 9. As seen in FIG. 10, one or more annular, triangular cross-sectional reliefs 178 can be disposed on the boundary profile 174. Similarly, as shown in FIG. 11, one or more annular, circular cross-sectional reliefs 179 can be disposed on the boundary profile 174. In FIGS. 9 through 11, the direction of fluid flow is denoted generally by an arrow 171. These surface features 176, 177, 178, 179 increase resistance to flow in the narrow annulus 170 by creating flow recirculation zones 300 adjacent the primary stream of drilling fluid flowing through the narrow annulus 170. These flow recirculation zones 300 (also depicted in FIG. 8) force fluid back into the primary stream of fluid, interrupting the flow of drilling fluid in the primary stream and increasing resistance to fluid flow.

Numerical studies performed with the aid of a computer indicate that: a series of annular, rectangular cross-sectional reliefs 177 on the boundary profile 174 as shown in FIG. 9 provides an approximate 10 percent increase in pressure loss; an annular, triangular cross-sectional relief 178 on the boundary profile 174 as shown in FIG. 10 provides an approximate 32 percent increase in pressure loss; and an annular, circular cross-sectional relief 179 on the boundary profile 174 as shown in FIG. 11 provides an approximate 39 percent increase in pressure loss through the narrow annulus 170. Again, increased pressure loss through the narrow annulus 170 directly translates to a reduction in flow split. Any other suitable surface or topographical feature may be used to alter the boundary profile 174 according to the invention in order to introduce flow resistance in the narrow annulus 170. Those of ordinary skill in the art will appreciate that any one of the surface features 176, 177, 178, 179 imparted to the boundary profile 174 will individually increase resistance to fluid flow through the narrow annulus 170. In other words, a surface feature 176, 177, 178, 179 introduced to the boundary profile 174 according to the present invention does not require a second, mating surface feature to increase resistance to fluid flow in the narrow annulus 170, as was suggested in the prior art (see discussion of prior art set forth above).

A core bit 100 according to the present invention may be manufactured using conventional core bit fabrication techniques. Machining, casting, or other suitable conventional metal forming techniques, or any combination thereof, may be used to form the novel features of the present invention, including: a port inlet 144 having a conical shape 147; a port inlet 144 having a relaxed angle of approach 148; an annular reservoir 180 having an increased radial width 182; and a narrow annulus 170 having a boundary profile 174 with one or more annularly extending squared edges 176, one or more annular, rectangular cross-sectional reliefs 177, one or more annular, triangular cross-sectional reliefs 178, or one or more annular, circular cross-sectional reliefs 179. All of the novel features of the core bit 100 according to the present invention are integral to the core bit 100 itself, and no modifications to other components of the conventional core barrel assembly, including the core shoe, are required. It will be appreciated by those of ordinary skill in the art that fabrication of the novel features of the core bit 100 does not—for proper functioning of the core bit 100 providing a reduced flow split during a coring operation—depend upon the maintenance of a close mating (or contacting) fit between two surfaces rotating relative to one another. Further, those of ordinary skill in the art will appreciate that the novel features of the core bit 100 will not significantly affect the mechanical strength of the core bit 100, as no weak structures—such as, for example, thin cross-sectioned geometric features—are imparted to the core bit 100.

A core bit 100 providing reduced flow split having been herein described, it will be appreciated by those of ordinary skill in the art that any combination of the novel features of the present invention may be incorporated into the core bit 100. For example, the core bit 100 may have, individually, a port inlet 144 with a shape 147 that is generally conical (see FIG. 6), a port inlet 144 having a relaxed angle of approach 148 (see FIG. 6), an annular reservoir 180 having an increased radial width 182 and increased volume (see FIGS. 6 and 8), or a narrow annulus 170 having a boundary profile 174 with surface features 176, 177, 178, 179 configured to increase resistance to fluid flow (see FIGS. 8 through 11). Alternatively, the core bit 100 may have any suitable combination of the novel features of the present invention. By way of example only, a port inlet 144 having a shape 147 that is conical may be used in combination with a relaxed angle of approach 148. Similarly, increased radial width 182 of the annular reservoir 180 may be used in combination with any one of the surface features 176, 177, 178, 179 incorporated into the boundary profile 174 of the narrow annulus 170.

Coring operations can be performed using the core bit 100 according to the present invention in the same manner as conducted using a conventional core bit 10. Because the novel aspects of the core bit 100 require only the fabrication of selected, robust geometric features in the bit body 112, and further because the reduction in flow split achieved in the present invention does not rely on the conventional techniques (maintaining a flow restriction comprised of a mating contact fit between two surfaces rotating relative to one another, or maintaining a flow restriction comprised of a flow gap formed between an annular lip rotating relative to a mating annular slot), the core bit 100 will be rugged and capable of withstanding the severe mechanical and chemical environments experienced during coring operations without noticeable degradation in performance. Also, as the present invention requires only construction of geometric features on the interior of bit body 112, the core bit 100 is adaptable for use with conventional core barrel assemblies and conventional core shoes. Thus, the core bit 100 having features to control flow split enables a drill operator to consistently obtain high-quality core samples with minimal fluid invasion using existing, conventional coring methods and equipment.

The foregoing detailed description and accompanying drawings are only illustrative and not restrictive. They have been provided primarily for a clear and comprehensive understanding of the present invention and no unnecessary limitations are to be understood therefrom. Numerous additions, deletions, and modifications to the preferred embodiment, as well as alternative arrangements, may be devised by those skilled in the art without departing from the spirit of the present invention and the scope of the appended claims.

What is claimed is:

1. A core bit, comprising:

a bit body having a face surface with a throat opening thereinto, the throat extending to a longitudinal cavity defined by at least one longitudinally oriented wall;

at least one cutter disposed on the face surface; and at least one bore extending through the bit body between at least one port inlet and at least one port outlet;

wherein the at least one port outlet is formed in the face surface of the bit body;

wherein the at least one port inlet is formed within the bit body and comprises a generally pyramidal shape; and wherein the at least one port inlet opens into the longitudinal cavity through at least a portion of the at least one longitudinally oriented wall.

2. A core bit, comprising:

a bit body having a face surface with a throat opening thereinto, the throat extending to a longitudinal cavity defined by at least one longitudinally oriented wall;

at least one cutter disposed on the face surface; and at least one bore extending through the bit body between at least one port inlet and at least one port outlet;

wherein the at least one port outlet is formed in the face surface of the bit body;

wherein the at least one port inlet is formed within the bit body and comprises a generally pyramidal shape; and wherein the at least one port inlet includes a first end having a first cross-sectional area joined to the at least one bore and extending to a second end having a second cross-sectional area larger than the first cross-sectional area, the second end opening into the longitudinal cavity through at least a portion of the at least one longitudinally oriented wall.

3. A core barrel assembly for cutting core samples in subterranean formations, comprising:

an outer barrel having one end attached to a drill string;

an inner barrel assembly rotatably disposed inside the outer barrel, the inner barrel assembly including an inner tube and a core shoe attached to one end of the inner tube;

a core bit attached to an opposing end of the outer barrel proximate the core shoe, the core bit including:

a bit body having a face surface with a throat opening thereinto, the throat extending to a longitudinal cavity defined by at least one longitudinally extending wall;

at least one cutter disposed on the face surface; and at least one bore extending through the bit body between at least one port inlet and at least one port outlet;

wherein the at least one port outlet is formed in the face surface of the bit body;

wherein the at least one port inlet is formed generally within the bit body and comprises a generally pyramidal shape; and wherein the at least one port inlet includes a first end having a first cross-sectional area joined to the at least one bore and extending to a second end having a second cross-sectional area larger than the first cross-sectional area, the second end opening into the longitudinal cavity through at least a portion of the at least one longitudinally oriented wall.

4. A core bit for attachment to a core barrel assembly, the core barrel assembly including an outer barrel, an inner tube disposed within the outer barrel, and a core shoe disposed at one end of the inner tube, comprising:

a bit body including a face surface and further including an inner, substantially cylindrical, longitudinally extending cavity bounded by an inside diameter of the bit body and configured to receive at least the core shoe therein;

wherein a flow path is defined by an unobstructed annular region having a longitudinally extending radially outer wall, a radially extending upper wall and a radially extending lower wall formed in the bit body and a radially inner periphery defined by an outside diameter of at least the core shoe;

at least one cutter disposed on the face surface; and at least one bore extending through the bit body between at least one port inlet and at least one port outlet;

wherein the at least one port inlet opens into the annular region and forms an angle of approach relative to the flow path defined by the annular region proximate the at least one port inlet of about 30 degrees;

wherein the at least one port outlet is formed in the face surface of the bit body.

5. A core barrel assembly for cutting core samples in subterranean formations, comprising:

an outer barrel having one end attached to a drill string;

an inner barrel assembly disposed inside the outer barrel, the inner barrel assembly including an inner tube and a core shoe attached to one end of the inner tube;

a core bit attached to an opposing end of the outer barrel proximate the core shoe, the core bit including:

a bit body including a face surface and further including an inner, substantially cylindrical, longitudinally extending cavity bounded by an inside diameter of the bit body, at least the core shoe extending into the cavity;

wherein a flow path is defined by an unobstructed annular region having a longitudinally extending radially outer wall, a radially extending upper wall and a radially extending lower wall formed in the bit body and a radially inner periphery defined by an outside diameter of at least the core shoe;

at least one fixed cutter disposed on the face surface;

at least one bore extending through the bit body between at least one port inlet and at least one port outlet;

wherein the at least one port inlet opens into the annular region and forms an angle of approach relative to the flow path defined by the annular region proximate the at least one port inlet of about 30 degrees;

wherein the at least one port outlet is formed in the face surface of the bit body.

6. A core bit for attachment to a core barrel assembly including a core shoe of a predetermined exterior configuration, the core bit comprising:

a bit body including a face surface and further including an inner, substantially cylindrical cavity longitudinally extending therethrough;

at least one cutter disposed on the face surface; and at least one bore extending through the bit body between at least one port inlet and at least one port outlet;

wherein the at least one port outlet is formed in the face surface of the bit body;

wherein the at least one port inlet opens into the cavity at a region thereof defining an unobstructed annular reservoir formed in a wall of the inner, substantially cylindrical cavity, the annular reservoir configured to induce fluid recirculation zones in fluid passing therethrough.

7. A core bit for attachment to a core barrel assembly, the core barrel assembly including an outer barrel, an inner tube disposed within the outer barrel, and a core shoe of a predetermined exterior configuration disposed at one end of the inner tube, comprising:

a bit body including a face surface and further including an inner, substantially cylindrical cavity longitudinally extending therethrough, at least the core shoe extending into the cavity;

at least one cutter disposed on the face surface; and at least one surface feature extending from a wall of the cavity configured to individually impart resistance to fluid flow in a narrow annulus defined by the wall of the cavity and an outside surface of the core shoe.

8. The core bit of claim 7, wherein the at least one surface feature is selected from the group consisting of: at least one annularly extending squared edge; at least one annular, generally rectangular cross-sectional relief; at least one annular, generally triangular cross-sectional relief; and at least one annular, generally circular cross-sectional relief.

9. A core barrel assembly for cutting core samples in subterranean formations, comprising:

an outer barrel having one end attached to a drill string;

an inner barrel assembly disposed inside the outer barrel, the inner barrel assembly including an inner tube and a core shoe of a predetermined exterior configuration attached to one end of the inner tube;

a core bit attached to an opposing end of the outer barrel proximate the core shoe, the core bit including:

a bit body including a face surface and further including an inner, substantially cylindrical cavity longitudinally extending therethrough, at least the core shoe extending into the cavity;

at least one cutter disposed on the face surface; and at least one surface feature extending from a wall of the cavity configured to individually impart resistance to fluid flow in a narrow annulus defined by the wall of the cavity and an outside surface of the core shoe.

10. The core barrel assembly of claim 9, wherein the at least one surface feature is selected from the group consisting of: at least one annularly extending squared edge; at least one annular, generally rectangular cross-sectional relief; at least one annular, generally triangular cross-sectional relief; and at least one annular, generally circular cross-sectional relief.

11. A core bit for attachment to a core barrel assembly, the core barrel assembly including an outer barrel, an inner tube disposed within the outer barrel, and a core shoe of a predetermined exterior configuration disposed at one end of the inner tube, comprising:

a bit body including a face surface and further including an inner, substantially cylindrical, longitudinally extending cavity bounded by at least one longitudinally oriented wall of the cavity, at least the core shoe extending into the cavity;

wherein a flow path is defined by an unobstructed annular region having a longitudinally extending radially outer wall, a radially extending upper wall and a radially extending lower wall formed in the wall of the cavity and an outside surface of at least the core shoe;

at least one cutter disposed on the face surface;

at least one port outlet disposed on the face surface;

at least one bore extending through the bit body between at least one port inlet and at least one port outlet; and wherein the at least one port inlet opens into the annular region and extends through a portion of the at least one longitudinally oriented wall and includes a first end having a first cross-sectional area joined to the at least one bore and extends to a second end having a second cross-sectional area larger than the first cross-sectional area, the at least one port inlet forming an angle of approach relative to the flow path defined by the annular region proximate the at least one port inlet of about 30 degrees.

12. The core bit of claim 11, further comprising at least one topographical feature disposed on the wall of the cavity configured to individually impart resistance to fluid flow in a narrow annulus defined by a portion of the wall of the cavity below the annular region and an outside surface of the core shoe.

13. A port structure for delivering drilling fluid to a face surface of a core bit attached to a core barrel assembly, the core barrel assembly including an outer barrel, an inner tube disposed within the outer barrel, and a core shoe disposed at one end of the inner tube adjacent the core bit, at least the core shoe extending into an inner, substantially cylindrical cavity longitudinally extending into the core bit, wherein a flow path is defined by an unobstructed annular region having a longitudinally extending outer wall, a radially extending upper wall and a radially extending lower wall formed in a wall of the cavity and a radially inner periphery defined by an outside surface of the core shoe, the port structure comprising:

a bore extending through the core bit between at least one port inlet and at least one port outlet; and wherein the at least one port inlet opens into the annular region and forms an angle of approach relative to the flow path defined by the annular region proximate the at least one port inlet of about 30 degrees.

14. A method of reducing a quantity of fluid flowing from an annular region bounded by a wall of a cavity through a core bit and an outside surface of a core shoe disposed therein, and into a narrow annulus therebelow defined by the wall of the cavity and the outside surface of the core shoe, the narrow annulus in fluid communication with the annular region, the method comprising:

providing a plurality of ports, each port including a bore and extending through the core bit between an inlet and an outlet;

reducing a quantity of fluid flow through the narrow annulus, the reducing comprising:

enlarging a cross-sectional area of the port inlet of each port of the plurality of ports relative to a cross-sectional area of the bore of each port of the plurality of ports, each port inlet of the each port proximate to the annular region; and receiving fluid from the annular region into the enlarged cross-sectional area of each port inlet.

15. The method of claim 14, further comprising recirculating fluid within the annular region.

16. The method of claim 14, further comprising imparting circumferential flow to fluid within the annular region.

* * * * *

UNITED STATES PATENT AND TRADEMARK OFFICE

CERTIFICATE OF CORRECTION

PATENT NO. : 7,055,626 B2
APPLICATION NO. : 10/099873
DATED : June 6, 2006
INVENTOR(S) : Michael R. Wells, Luc Van Puymbroeck and Holger Stibbe It is certified that error appears in the above-identified patent and that said Letters Patent is hereby corrected as shown below:

| | | |
|---|---|---|
| COLUMN 1, | LINE 21, | change “formations—including” to --formations, including-- |
| COLUMN 1, | LINES 22, 23 | change “satura-tion—that” to --saturation, that-- |
| COLUMN 1, | LINE 41, | change “is cut—by” to --is cut, by-- |
| COLUMN 1, | LINE 43, | change “components—the” to --components, the-- |
| COLUMN 5, | LINE 48, | change “cutters **30**—shown” to --cutters **30**, shown-- |
| COLUMN 5, | LINE 49, | change “FIG. **3**—includes” to --FIG. **3**, includes-- |
| COLUMN 5, | LINE 54, | change “line)” to --lines)-- |
| COLUMN 6, | LINE 2, | change “inner substantially” to -- inner, substantially-- |
| COLUMN 6, | LINE 3, | change “inner substantially” -- inner, substantially-- |
| COLUMN 6, | LINE 51, | change “annulus **70**—the flow split—will” to --annulus **70**, the flow split, will-- |
| COLUMN 7, | LINE 4, | change “dashed line)” to --dashed lines)-- |
| COLUMN 9, | LINE 10, | change “core bit **100** as” to --core bit **100**, as-- |
| COLUMN 10, | LINE 59, | change “not—for” to --not, for-- |
| COLUMN 10, | LINE 60, | change “operation—depend” to --operation, depend-- |
| COLUMN 10, | LINE 67, | change “structures—such as,” to --structures, such as,-- |
| COLUMN 10, | LINE 68, | change “features—are” to --features, are-- |

Signed and Sealed this

Fourth Day of September, 2007

JON W. DUDAS
*Director of the United States Patent and Trademark Office*